United States Patent [19]

Buchner et al.

[11] 4,304,574

[45] Dec. 8, 1981

[54] HEATING SYSTEM FOR FLUIDIZED BED GAS GENERATOR

[75] Inventors: Güenter Buchner, Meerbusch; Johannes Alkemper, Bottrop; Rainer Dürrfeld, Essen; Heinz Gaessler, Mulheim, all of Fed. Rep. of Germany

[73] Assignees: Mannesmannröhren-Werke AG, Dusseldorf; Bergwerksverband GmbH, Essen-Kray, both of Fed. Rep. of Germany

[21] Appl. No.: 131,275

[22] Filed: Mar. 17, 1980

[30] Foreign Application Priority Data

Mar. 15, 1979 [DE] Fed. Rep. of Germany ..... 2910436
Mar. 15, 1979 [DE] Fed. Rep. of Germany ..... 2910437

[51] Int. Cl.[3] ..... C10B 1/06

[52] U.S. Cl. ..... 48/99; 48/101; 122/510; 165/83; 165/163; 422/146

[58] Field of Search ..... 422/146; 48/99, 89, 48/101; 165/162, 163, 104 F, 82; 122/5, 510; 201/33

[56] References Cited

U.S. PATENT DOCUMENTS

| | | | |
|---|---|---|---|
| 2,664,346 | 12/1953 | Mayhew | 422/146 |
| 2,751,756 | 6/1956 | Hughes et al. | 422/146 |
| 2,940,735 | 6/1960 | Marsh | 165/104 F |
| 2,995,426 | 8/1961 | Keith | 422/146 |
| 3,259,112 | 9/1964 | Lee | 122/510 |
| 4,080,181 | 3/1978 | Feistel et al. | 422/146 |

FOREIGN PATENT DOCUMENTS

| | | | |
|---|---|---|---|
| 2423951 | 11/1975 | Fed. Rep. of Germany | 48/99 |

*Primary Examiner*—S. Leon Bashore
*Assistant Examiner*—Michael L. Goldman
*Attorney, Agent, or Firm*—Smyth, Pavitt, Siegemund & Martella

[57] ABSTRACT

The retort chamber for generating gas by applying hot steam to coal in a fluidized bed is heated by meandering tubes, dipping into the bed, and being suspended from long, hollow boxes which, in turn, are particularly suspended in the retort chamber. The boxes support also manifold tubes connected to the heating tubes and being further connected to a heating fluid feed and distribution as well as a collecting and discharge system.

7 Claims, 4 Drawing Figures

HEATING SYSTEM FOR FLUIDIZED BED GAS GENERATOR

BACKGROUND OF THE INVENTION

The present invention relates to the heating of a fluidized bed for the purpose of generating gas from coal and steam under pressure.

The German Pat. No. 2,423,951 describes a generator of the type to which the invention pertains. The generator includes a stationary, cylindrical retort chamber being traversed by heating tubes. A perforated pan or trough divides the chamber into a flat, lower space and a high, upper space. The steam-feeding conduit terminates in the upper space or chamber, while coal is fed to the lower space. Also, residue as well as the useful gas are taken, i.e. extracted, from the lower space or chamber. Contoured rails support the pan. The heating tubes dip into the fluidized bed from above, in a meandering or hairpin-like configuration. These heating tubes are positioned so that the bending plane of their curved portions extends lengthwise to the axis of the retort cylinder. The heating tubes are manifolded, the manifold tubes being suitably supported in the upper space or chamber.

It was found that the suspension system for the tubes in this arrangement is not adequate and reliable, the load on the manifold tubes is too large.

It is, therefore, an object of the present invention to improve the manifold structure and its support for and in fluidized bed generators of the type referred to above.

DESCRIPTION OF THE INVENTION

Aside from the load problem and its solution, it is an object of the present invention to improve the thermal compensation of the support of manifolded heating tubes in a retort of the type referred to in the introduction, without requiring the introduction of additional forces.

It is, more generally, a further object of the present invention to improve heating throughput in heating systems for fluidized bed generators under reduction of the velocity of the heating fluid as well as under reduction of pressure losses therein.

It is a specific object of the present invention to provide a new and improved heating system for retort chambers of cylindrical construction, the cylinder lying sideways and being provided for sustaining a fluidized bed of coal and steam.

In accordance with the preferred embodiment of the invention, it is suggested to suspend two boxes transverse to the cylinder axis and parallel to each other. Heating tubes extend down from these boxes; and manifold tubes for communicating with the tubes rest on the boxes, each manifold tube resting on both boxes. The boxes are preferably suspended from the cylinder jacket by means of tubes which communicate with the boxes for passage of a cooling fluid. These suspension tubes are connected to that jacket via a thermal compensation structure. The suspension tubes as well as the boxes are thermally insulated.

The thermal compensation structure includes a pressurized cylinder and a joint through which the suspension tubes are themselves suspended, there being a seal between the joint and the interior of the retort chamber.

The other side of the pressurized cylinder may communicate with the retort chamber.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof, will be better understood from the following description taken in connection with the accompanying drawings, in which:

Figure 1:
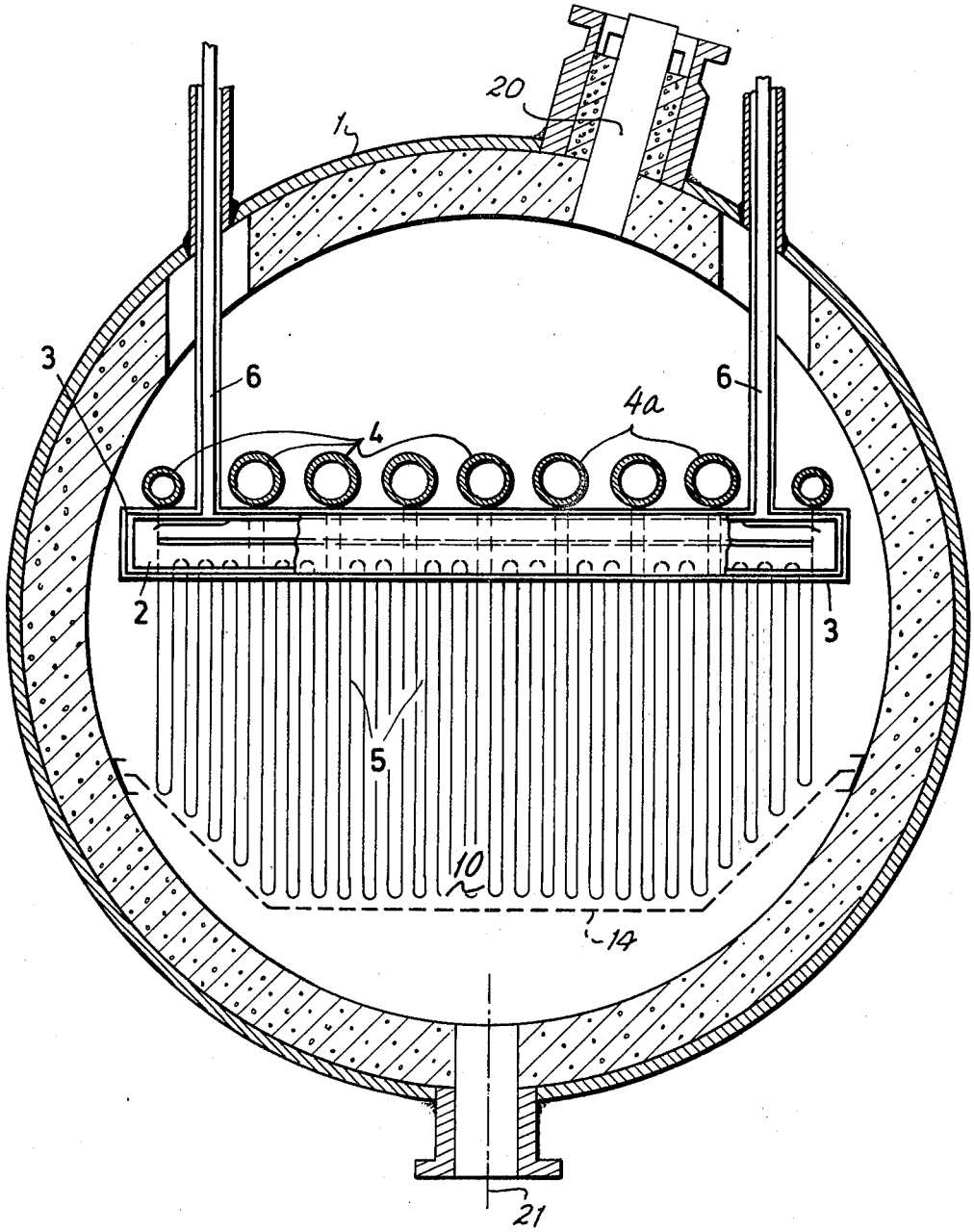
FIG. 1 is a cross section through a retort chamber for generating a heating-fluidized bed of coal and steam, showing particularly the suspension of heating tubes in accordance with the preferred embodiment of the invention.

Proceeding now to the detailed description of the drawings, the figures show a cylindrical retort, lying on its side and having an outer jacket 1, constituting the basic support and construction frame. Two elongated, horizontally disposed boxes 2 and 2' are suspended from jacket 1 by means of tubes 6.

The boxes, 2 and 2', are covered completely by insulation 3, and the insulation is extended to cover also the tubes 6. The hollow interior of the boxes are flown through by a coolant, fed respectively into a box by one of the tubes 6 and discharged from the respective box by the other one of suspending tubes.

The boxes are of single-piece construction and very stiff; they extend transversely to the axis of the cylindrical retort. They will not be heated to the internal reactor temperature of, say, 900° C., due to the insulation coverage 3 and the internal cooling.

These suspension boxes 2 and 2' serve as support from which several meandering tubes 5 are suspended to dip into the lower space of a retort chamber 10. A perforated trough 14 is provided; 20 is the gas outlet. The lower portions of these tubes have been omitted. The retort chamber 10 is connected conventionally to steam feeder lines 21 and coal feeder facilities, and a fluidized bed is maintained in the bottom portion of the sideways-lying cylinder for the purpose of gasification. The bed is heated by these tubes 5.

Each one of tubes 5 has one end connected to one of the manifold tubes 4, while the other end of such a tube is connected to a manifold tube **4*a*. Tubes 4 and 4*a* are alternatingly placed on top of the two boxes 2 and 2', whereby each one of these tubes is supported by both boxes. The tubes 4 are centrally connected to conduits 11, extending from a ball-shaped collector chamber 13 in which terminates a duct 12 being run into the retort chamber from above. The tubes 4*a* are analogously connected centrally to conduits 11*a* which, in turn, originate in a spherical collector chamber 13*a*. Chamber 13*a* is connected to a duct 12*a*** which is also fed through the top of the sideways-lying, cylindrical retort.

The central connection of the ducts or conduits, 11 and **11*a***, to the respective manifold tubes is highly instrumental in reducing flow pressure losses of the heating medium as conducted through. Also, the flow speed of that medium is kept quite low for higher efficiency.

Heating fluid is fed to one of the ducts 12 and 12*a* and distributed by the conduit and manifold tube system (4 or 4*a*), in order to pass into and through the various tubes 5; the heating fluid returns to the other manifold tubes, the conduits, the other spherical chamber, and is discharged through duct 12*a* or 12. Thus, one of the systems 11, 12, 13 and 11*a*, 12*a*, 13*a* is a heating fluid feed and distribution system, the other one is a collecting and discharging system for this heating fluid.

Figure 3:
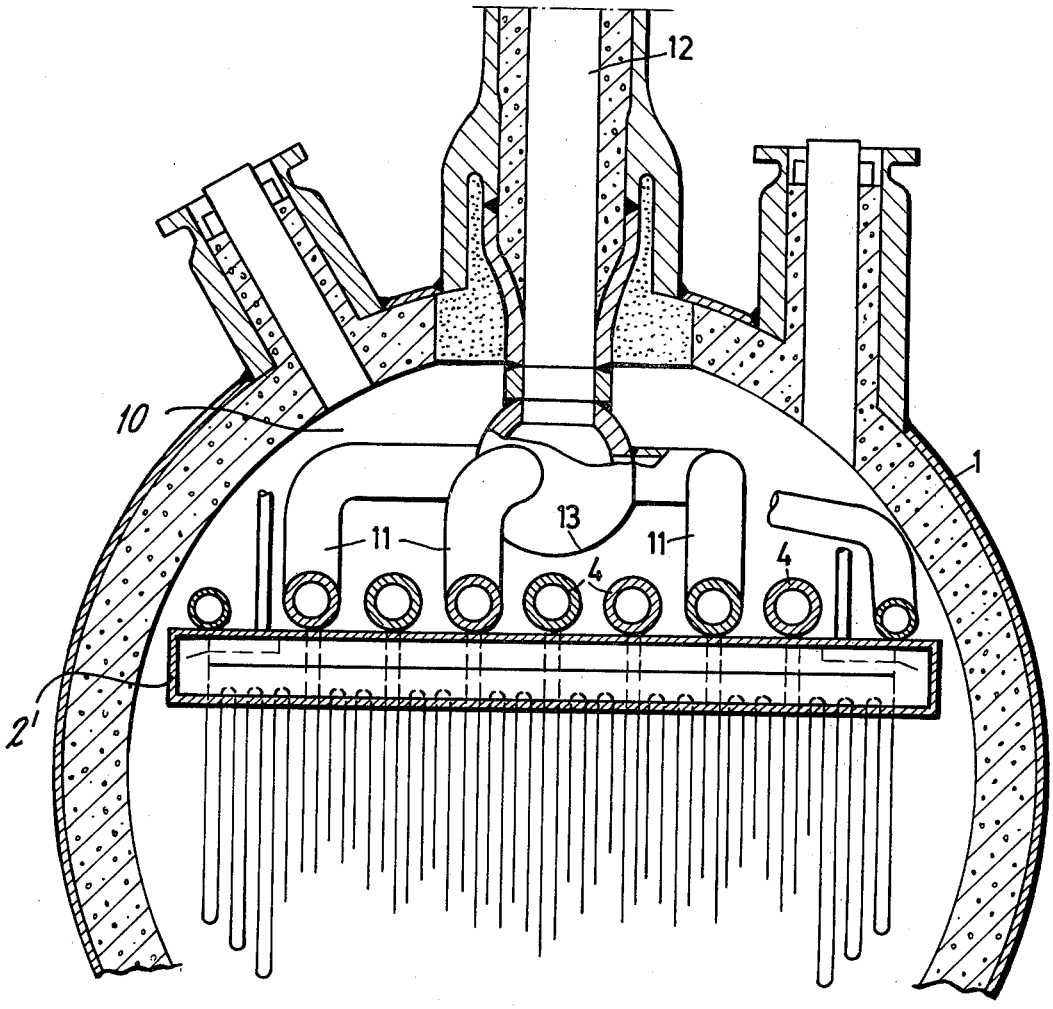
FIG. 3 is a cross section through the retort shown in FIG. 1, but in a different, parallel section plane.
Figure 4:
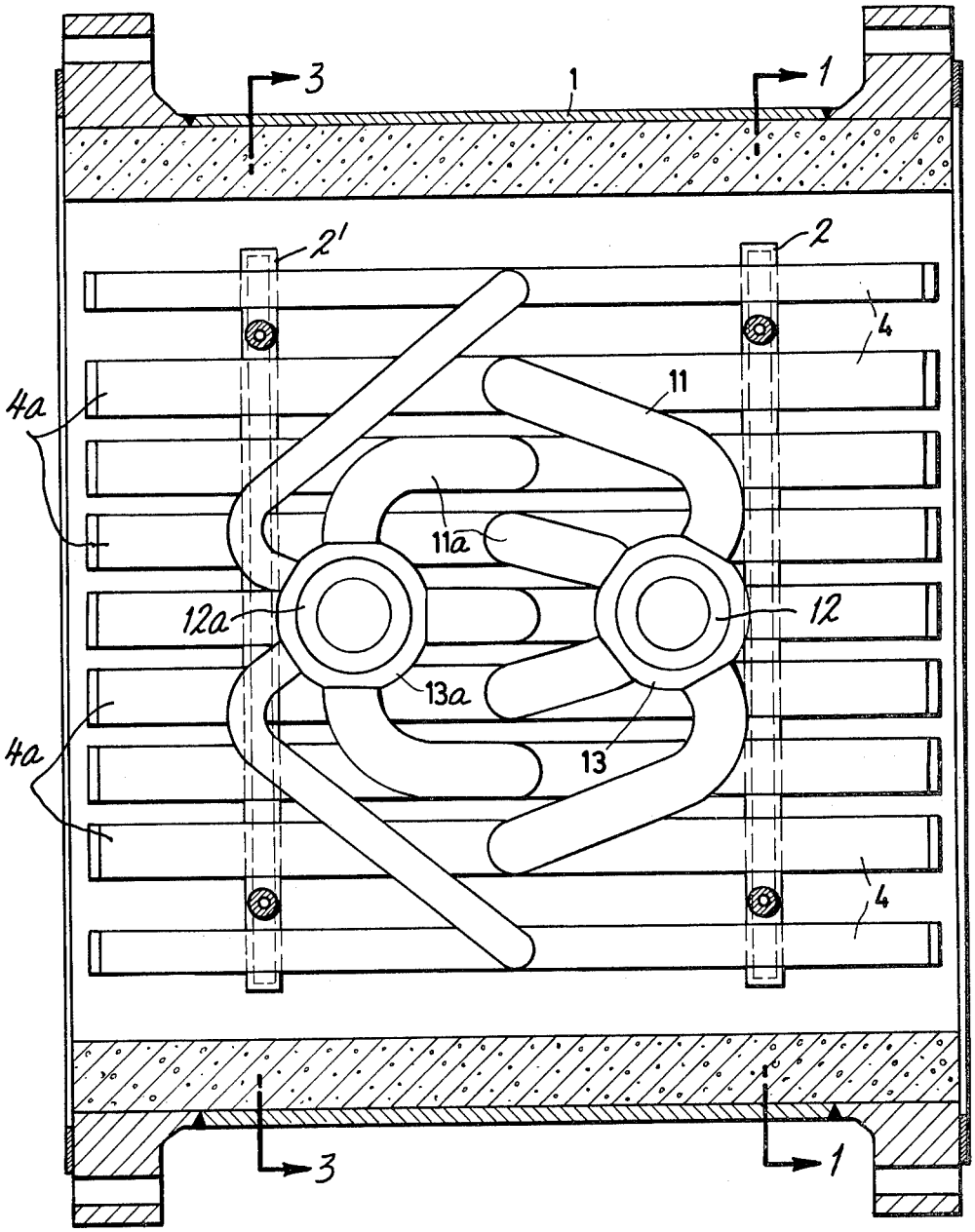
FIG. 4 is a longitudinal section view through the chamber shown in FIGS. 1 and 3.

It should be noted that in the view of FIG. 3 the system 11*a*, 12*a*, and 13*a* has been omitted to permit a clear view of the system 11, 12, and 13.

As far as boxes 2 and 2' are concerned, the heating tubes 5 are suspended from them, and the manifold tubes 4 and 4*a* rest on them. The manifold tubes do not support the heating tubes 5. It should be noted that also the weight of conduit systems 11 and 11*a* and of the spherical chambers 13 and 13*a* is at least to some extent taken up by suspension tube 6.

Figure 2:
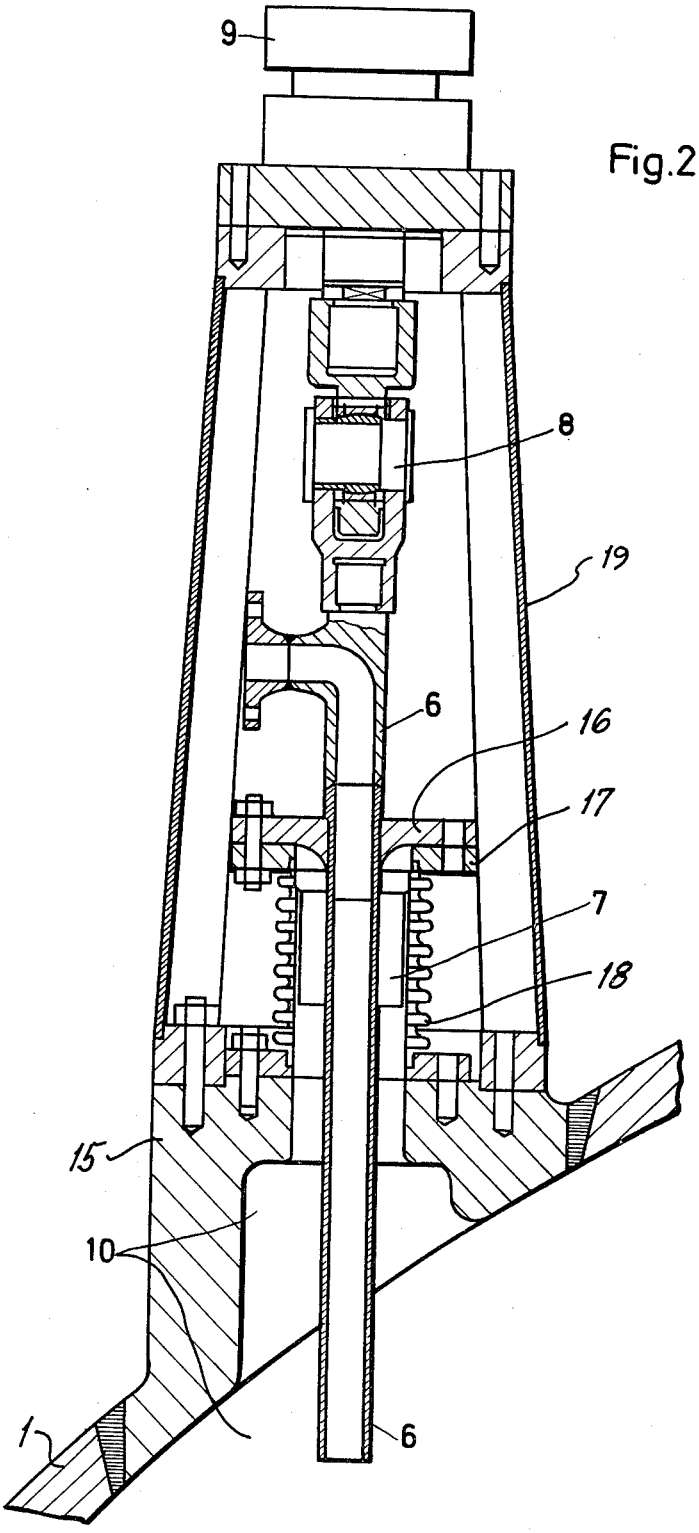
FIG. 2 is a section view of a detail of the suspension system shown in FIG. 1 and being drawn to a larger scale.

One of the suspensions 6 for boxes 2 and 2' is shown in greater detail in FIG. 2. A support and mount 15 of suitable contour is welded to the retort jacket 1. The particular suspension tube 6 has a flange 16 mounted on a disk 17 which is connected to mount 15 via corrugated tubing 18. The corrugated tubing is sealed by means of a sealing cylinder 7 on suspension tube 6.

The upper portion of suspension tube 6, bent off for feeding or discharge of a coolant, and the L-shaped joint element are connected to a joint 8 whose other end is connected to a piston in a pressurized cylinder 9. The load carried by tube 6 via joint 8 is, thus, supported by the pressure in that cylinder. A pressure equalization duct applies the pressure of retort chamber 10 to the other side of the piston.

The cylinder 9 is supported by a frame 19 on mount 15. This particular assembly compensates thermal expansion of tube 6, as suspending one of the boxes 2 and 2'. Particularly joint 8 compensates for lateral thermal expansion of the respective box and prevents binding of the piston in cylinder 9.

The invention is not limited to the embodiments described above; but all changes and modifications thereof, not constituting departures from the spirit and scope of the invention, are intended to be included.

We claim:

1. In a gas generator, using a fluidized bed of steam and coal generated and maintained in a horizontally positioned stationary cylinder, having an axis and a jacket, a heating system, comprising:

a first and a second single-piece, long, hollow box, each being internally cooled and thermally insulated over its outer surface, said boxes having a horizontal disposition in and transversely to the axis of the cylinder, and being spaced from each other in a direction transverse to their axes;

a first and a second plurality of heating tubes respectively suspended from the first and second boxes for downward extension, but not communicating with the hollow interior thereof;

a plurality of manifold tubes supported on the boxes, each manifold tube lying on both boxes, said manifold tubes being connected to the heating tubes, in that each heating tube is connected to two of the manifold tubes for respectively feeding and discharging heating fluid;

heating fluid feed and discharge duct means inside the cylinder and connected to the manifold tubes to respectively feed to some of them heating fluid and to receive heating fluid from others; and suspension means for suspending each of the boxes from above and bearing against the outer jacket of the cylinder and including thermal-expansion-compensating means.

2. In a generator as in claim 1, the suspension means for each box including two hollow, thermally insulated tubes, communicating with the interior of the box for passage of cooling fluid.

3. In a generator as in claim 2, wherein each hollow tube is carrying a load and is biased by means of a pressurized cylinder.

4. In a generator as in claim 2 or 3, wherein each of the suspension tubes is suspended via a joint to take up lateral thermal expansion of the respective box.

5. In a generator as in claim 3, the pressurized cylinder communicating with the interior of the horizontally positioned stationary cylinder.

6. In a generator as in claim 1, the heating fluid feed and discharge means including a first and a second collector, each being separately connected to a single feed-through means traversing the cylinder, the first collector being connected to some of the manifold tubes, the second collector being connected to the remaining ones of the manifold tubes.

7. In a generator as in claim 6, the first and second collectors being spherically shaped.

* * * * *